US009097470B2

(12) United States Patent
Chen et al.

(10) Patent No.: US 9,097,470 B2
(45) Date of Patent: Aug. 4, 2015

(54) INTERNAL LIQUID SEPARATING HOOD-TYPE CONDENSATION HEAT EXCHANGE TUBE

(75) Inventors: Hongxia Chen, Beijing (CN); Jinliang Xu, Beijing (CN); Wei Wang, Beijing (CN)

(73) Assignee: NORTH CHINA ELECTRIC POWER UNIVERSITY, Beijing (CN)

( * ) Notice: Subject to any disclaimer, the term of this patent is extended or adjusted under 35 U.S.C. 154(b) by 1 day.

(21) Appl. No.: 13/984,659

(22) PCT Filed: Mar. 5, 2012

(86) PCT No.: PCT/CN2012/000274

§ 371 (c)(1),
(2), (4) Date: Aug. 9, 2013

(87) PCT Pub. No.: WO2013/016943

PCT Pub. Date: Feb. 7, 2013

(65) Prior Publication Data

US 2014/0138861 A1 May 22, 2014

(30) Foreign Application Priority Data

Jul. 29, 2011 (CN) ..... 2011 1 0214877

(51) Int. Cl.

| | |
|---|---|
| ***B01F 3/04*** | (2006.01) |
| ***F28F 1/10*** | (2006.01) |
| ***F28F 13/04*** | (2006.01) |
| ***F28F 9/013*** | (2006.01) |
| ***F28D 15/04*** | (2006.01) |
| ***F28F 1/42*** | (2006.01) |
| ***F28F 1/16*** | (2006.01) |
| *F28D 15/02* | (2006.01) |

(52) U.S. Cl.

CPC ..... *F28F 1/10* (2013.01); *F28D 15/046* (2013.01); *F28F 1/16* (2013.01); *F28F 1/426* (2013.01); *F28F 9/013* (2013.01); *F28F 13/04* (2013.01); *F28D 15/025* (2013.01)

(58) Field of Classification Search

CPC ..... F28D 15/025; F28D 15/046; F28F 1/10; F28F 1/16; F28F 1/426; F28F 9/013; F28F 13/04

USPC ..... 261/154, 155, 156

See application file for complete search history.

(56) References Cited

U.S. PATENT DOCUMENTS 3,537,514 A * 11/1970 Levedahl ..... 165/104.26
4,448,043 A * 5/1984 Aragou ..... 62/515
4,794,983 A * 1/1989 Yoshida et al. ..... 165/133

(Continued)

*Primary Examiner* — Charles Bushey

(74) *Attorney, Agent, or Firm* — Jackson IPG PLLC; Demian K. Jackson

(57) ABSTRACT

An internal liquid separating hood-type condensation head exchange tube, comprising an external heat exchange tube and an internal liquid separating hood disposed in the cavity of the external heat exchange tube and coaxial with the external heat exchange tube. The internal liquid separating hood is a hollow tube with a plurality of micropores or gaps distributed on a wall surface. The condensate formed during the heat exchange is pumped to the internal liquid separating hood in time under the effect of surface tension of the liquid via the micropores or gaps, and then is discharged from the heat exchange tube by the internal liquid separating hood. Vapor is retained to flow in the annular region between the external heat exchange tube and the internal liquid separating hood, so the inner wall of the external heat exchange tube comes into contact with the vapor to the greatest extent.

10 Claims, 2 Drawing Sheets

(56) References Cited

U.S. PATENT DOCUMENTS 4,880,054 A * 11/1989 Yoshida et al. ..... 165/133
6,428,863 B1 * 8/2002 Leipertz et al. ..... 427/528
6,925,711 B2 * 8/2005 Kilmer et al. ..... 29/890.053

* cited by examiner

INTERNAL LIQUID SEPARATING HOOD-TYPE CONDENSATION HEAT EXCHANGE TUBE

FIELD OF THE INVENTION

The invention belongs to the heat transfer enhancement technical field and relates to an internal liquid separating hood-type condensation heat exchange tube for improving the performance of condensation heat transfer.

BACKGROUND OF THE INVENTION

Condensation phase-change heat exchangers (i.e. condensers) are widely employed in fields of refrigeration, air conditioning, power generation, petrifaction, etc., due to high efficiency of phase-change heat transfer. In some applications, for example, in a case of an ORC cycle drived by a low-grade heat source including waste heat, solar thermal energy and geothermal energy, etc, the temperature and pressure in a condenser shall be lowered as much as possible result in small exergy loss and high efficiency, yielding a good system performance to achieve large power output from the thermodynamic cycle point of view, so that the condenser works under a small temperature difference (small temperature difference between an organic working medium in the tube and air or cooling water outside the tube), as a result, the heat exchange area and the investment cost are increased. Meanwhile, in fields of refrigeration, air conditioning, petrifaction, etc., further improving the condensation heat exchange efficiency may greatly reduce the cost, thereby having significant economic and social benefits. This provides significant requirements on the design, manufacturing and operation of a high-efficiency condenser.

Condensation phase-change is an important process in the two-phase flow science. Volume fraction of gas and liquid gradually change during the continuous evolution of the condensation process from a vapor state to a liquid state in the tube, so that different flow patterns, such as wet vapor flow, annular flow, stratified flow, slug flow, plug flow and bubble flow, present during the process. Meanwhile, due to continuous transform and accumulation of the condensate, small liquid droplets, a thin liquid film, a thick liquid film, a liquid bridge and finally a full-liquid state form in sequence. As the reported of studies, the annular flow in the state of a thin liquid film has the highest heat transfer efficiency, that is because the thin condensate film increases the heat exchange coefficient between vapor and solid. During the whole condensation, as the flow pattern is turned into the stratified flow, slug flow and plug flow from the annular flow, the liquid film with a certain heat resistance is gathered and become thicker and thicker even the liquid bridge state, the heat transfer resistance is obviously increased, so that the heat transfer coefficient is gradually decreased and the heat transfer efficiency is obviously deteriorated during the condensation. Therefore, the formation of thick liquid film during the condensation is the primary cause of the deterioration and attenuation of the heat exchange efficiency of the condensation tube.

At present, the conventional method for the condensation heat transfer enhancement use various types of enhanced tubes, for example, micro-fin tubes, groove tubes, corrugated tubes, and enhanced tubes with inserts. In the aspect of the enhancing effect, a micro-fin tube is generally more obvious by strengthening the mixing of the condensate film and resulting in disturbance of fluid close to the wall in the tube, so that the condensation heat transfer coefficient of a smooth tube may be improved by 80% to 180%. But for a groove tube with different oblique angles, the enhancing effect of the groove tube depends on the speed of the mass flow, that is, the greater the speed of the mass flow is, the quicker the export of the condensate, so the enhancing effect is more obvious. An enhanced corrugated tube generally may improve the heat transfer coefficient of a smooth tube by 50%. In addition, an enhanced tube with inserted a dual-helical filament structure may also obviously enhance the condensation heat exchange performance. However, for condensation enhanced tubes used at present, the heat transfer coefficient can be increased by mixing the fluid boundary layers and also by limiting the growth of fluid boundary layers close to the heat transfer surfaces, but no attention is paid to the modulation of the condensation flow patterns, and no design is made on the basis of the evolution of flow patterns. Those enhanced tubes have the following common points. (1) A fine structure of inner wall mainly changes the flowing and heat transfer performance in a near-wall region, incapability of regulating the flow patterns as a whole. (2) Although with an enhancing effect, the enhanced structure of inner wall fails to change the deteriorated evolution of heat transfer performance along the direction of length of the condensation tube. (3) The enhanced tube increases the difficulty of manufacturing, so the cost of a condenser is increased.

In 2007, Professor Peng Xiaofeng (*Technical Principle and Practices of High-performance Condensers*, Peng Xiaofeng, Wu Di, Zhang Yang, Chemical Industry and Engineering Progress, 2007, 26(1):97-104.), of Tsinghua University point out that the condensation heat transfer performance deteriorates along the length of the heat exchange tube with the assumption of a thin liquid film formed in the whole condensation tube according to Nusselt laminar flow and film condensation in which the liquid film thickness (δ) and average surface heat transfer coefficient ($h_{ave}$) are direct proportion to $L^{1/4}$ and $E^{-1/4}$ respectively, where L is the tube length, Thus he suggested a high efficiency condensation tube with the short-tube effect, yielding the subsequent low-heat-transfer flow pattern of the condensation in the heat transfer tube is abandoned, while the initial high-heat-transfer flow pattern is remained. in addition, the method of feeding the vapor phase obtained by vapor-liquid separation using the gravity at the outlet of the short tube into the next short tube for further condensation to always maintain the condensation flow pattern as the annular flow obviously improves the heat transfer efficiency of the condensation heat transefer tube. The heat transfer performance is enhanced based on the mastering the heat transfer characteristic of condensation flow patterns and the science process of condensation. However, the consideration enhancement method of this document is to directly avoid flow patterns with poor heat transfer efficiency and shorten the length of the heat exchange tube. Meanwhile, the method of separating vapor from liquid by the gravity requires different design of a condenser for heat exchangers with different oblique angles, so the application has a certain limitation under microgravity.

In conclusion, obviously improving the condensation heat transfer performance and fundamentally solving the deterioration along with the tube length must regulate the flow pattern based on understanding of the mechanism of condensation process. The invention provides a novel internal liquid separating hood-type condensation heat exchange tube, different from the technique disclosed by Professor Peng Xiaofeng, according to features of thickened liquid film and increased heat resistance during the evolution of condensation, in which the condensate is timely guided and separated, thereby obtaining a high-efficiency condensation heat exchange tube capable of regulating the flow pattern and fundamentally improving the condensation heat exchange efficiency.

SUMMARY OF THE INVENTION

To change the incompatibility of flow patterns and heat transfer in traditional methods of heat transfer enhancement and solve the key problem that the thick liquid film formed during the condensation in the direction of the tube length makes the heat transfer deteriorated, the invention provides an internal liquid separating hood-type condensation heat exchange tube different from the prior art. Based on a novel concept of modulation the condensation heat transfer flow pattern to improve and perfect the condensation heat transfer flow and heat transfer performance, Such condensation heat exchanger tube may fundamentally and greatly improves the condensation phase-change heat transfer performance.

An internal liquid separating hood-type condensation heat exchange tube is provided, comprising an external heat exchange tube, a coaxial internal liquid separating hood with smaller diameter inserted to the external heat exchange tube, the internal liquid separating hood being a hollow tube with a wall surface of a porous structure, the porous structure referring to a structure where a plurality of micropores or gaps with an equivalent diameter of d, $$d \leq 1.83\sqrt{\frac{\sigma}{g(\rho_f - \rho_g)}},$$

are distributed on the wall surface, the Plurality referring to more than two, where: σ represents the surface tension of the condensate, g represents the acceleration of gravity, $\rho_f$ represents the density of the condensate, and $\rho_g$ represents the density of vapor phase.

The working principle of the invention is as follows: because the characteristic scale of the micropores or gaps on the internal liquid separating hood is less than or equal to the scale which the surface tension force of liquid as the major role, when the vapor-liquid mixture flows in the annular space between the external heat exchange tube and the internal liquid separating hood, two phase flows are separated under the action of the liquid surface tension. The condensate formed during the heat exchange is captured by the micropore or gap structure of the internal liquid separating hood and flows inside the internal liquid separating hood and is discharged from the condensation heat exchange tube in time via the internal liquid separating hood, while the vapor is prevented from entering the micropores or gaps due to the increased surface energy and flow in the annular space between the external heat exchange tube and the internal liquid separating hood so that the inner wall of the external heat exchange tube comes into contact with the vapor to the greatest extent. In addition, a thin liquid film is formed on the inner wall surface of the external heat exchange tube, thereby regulating the flow pattern to ensure high-efficiency heat exchange of the thin liquid film in the direction of the whole tube length and improving the condensation heat transfer coefficient obviously.

The external heat exchange tube is an ordinary condensation heat exchange tube, which may be in all types of heat exchange tubes in the current researches and applications, such as smooth heat exchange tubes, or vertical fin tubes, spiral fin tubes, groove tubes, corrugated tubes, and other heat exchange tubes with an expanded heating area.

The internal liquid separating hood may include two parts: a drag reduction hood and a primary liquid separating hood. The internal liquid separating hood is the key component of a high-efficiency condensation heat exchange tube that capture the condensate in time and delivers it to the tail end of the condensation heat exchange tube via the micropore or gap structure on the wall surface based on the principle of capillary effect or liquid surface tension, thereby regulating the flow pattern and fundamentally improving the condensation heat exchange efficiency.

To reduce the resistance of the condensed steam at the inlet, the part of the internal liquid separating hood close to the inlet of the condensation heat exchange tube is designed to be a drag reduction hood with an oblique angle towards the flow direction of the fluid. The drag reduction hood may be a hollow truncated cone, cone or other streamline shapes gradually expanding towards the flow direction of fluid, the length of which is corresponding to the sum of length of all flow patterns prior to the annular flow pattern in the condensation process. The tail end of the drag reduction hood is connected with the start end of the primary liquid separating hood that is in a shape of circular tube, and the space between the outer diameter of the circular tube and the external head exchange tube is slightly larger than the thickness of the annular flow liquid film. The tail end of the primary liquid separating hood is aligned with that of the external heat exchange tube, and the separated condensate is discharged from the tail end of the primary liquid separating hood in time and further discharged from the condensation heat exchange tube.

The micropores or gaps on the wall surface of the internal liquid separating hood may be circular pores, square pores or slits, etc., in a same size or different sizes, and may be distributed uniformly, non-uniformly, in parallel, in a staggered form, crosswise, or in other forms. The porous structure of the internal liquid separating hood may be machined on the wall surface of a metal bare tube, or, the internal liquid separating hood may be directly machined from porous materials such as metal wire meshes, foam metal tubes, even porous ceramics, with advantages of low cost, wide material selection range and simple machining. The specific aperture size and distribution of the micropores or gaps is related to the surface tension and condensation amount of the condensate. For different condensation working mediums, the equivalent diameter of the micropores or gaps of the internal liquid separating hood is d, $$d \leq 1.83\sqrt{\frac{\sigma}{g(\rho_f - \rho_g)}},$$

where: σ represents the surface tension of the condensate, g represents the acceleration of gravity, $\rho_f$ represents the density of the condensate, and $\rho_g$ represents the density of vapor phase. If the surface tension of the condensation working medium is higher, the equivalent diameter will be slightly larger, whereas slightly smaller. For water, the diameter of a capillary pore is between 1 mm and 2 mm, analogous to the diameter of a capillary pore for different working mediums and mixtures. By the porous structure of the internal liquid separating hood in the invention, the thick liquid film in the stratified flow and the liquid bridge in the slug flow during the condensation process may be separated and exported in time, and the asymmetry of the flow pattern in the horizontal heat exchange tube may also be effectively corrected, thereby regulating the flow pattern, optimizing the flow pattern and improving the condensation heat transfer efficiency.

Several supports are provided between the inner wall of the external heat exchange tube and the internal liquid separating hood, similar to the internal liquid separating hood. The supports in this invention may also be of a porous structure with wide material selection range. The equivalent diameter of the porous structure also meets the following formula:

$$d \leq 1.83\sqrt{\frac{\sigma}{g(\rho_f - \rho_g)}}.$$

The first function of the supports is to support the internal liquid separating hood and make the internal liquid separating hood distributed in the external heat exchange tube uniformly. The second function is liquid discharging, that is, the condensate in a region near the inner wall of the external heat exchange tube is pumped to the liquid separating hood in time via the micropores of the supports by using a capillary porous structure and surface tension force, thereby further improving the separation efficiency of the liquid separating hood. Meanwhile, discharging the condensate in the near-wall region improves the update rate of the condensate in the near-wall region and maintains the super-cooled temperature of the condensation wall surface.

The invention has the following advantages and effects. (1) The internal liquid separating hood-type condensation heat exchange tube separates the condensate in time during the condensation process via the internal liquid separating hood, so the stratified flow liquid film may be effectively thinned and the liquid bridge of the slug flow may be eliminated; the slug flow or thick liquid film resulting in deteriorated heat transfer is turned into the high-efficiency heat transfer annular flow; and the method of condensation enhancement by the condensation heat exchange tube fundamentally solves the problem of deteriorated condensation heat transfer process on the basis of scientific understanding of the physical process of condensation. (2) Discharging the liquid via a capillary force or liquid surface tension in the invention is a passive process without energy consumption; the effects are not influenced by the gravity and not limited by the oblique angle of the condensation heat transfer tube. Thus, this structure not only may be employed in ordinary condensation heat transfer occasions, but also may be popularized to the condensation heat transfer under microgravity. The heat transfer efficiency of a condensation phase-change heat exchange tube is improved obviously with small or acceptable increase of pressure drops.

BRIEF DESCRIPTIONS OF THE DRAWINGS

In these figures, (1) refers to the external heat exchange tube, (2) refers to the internal liquid separating hood, (3) refers to the supporting structure, (4) refers to the drag reduced hood, (5) refers to the primary liquid separating hood, (6) refers to porous structure, (7) refers to the vertical channel, (8) parallel channels, (9) refers to the flow direction of liquid in the internal liquid separating hood, (10) refers to the fluid flow direction in the annular region between the external heat exchange tube and the internal liquid separating hood.

DETAILED DESCRIPTIONS OF THE INVENTION

The invention will be described as below with reference to the drawings, but will not be limited in any way.

Figure 1:
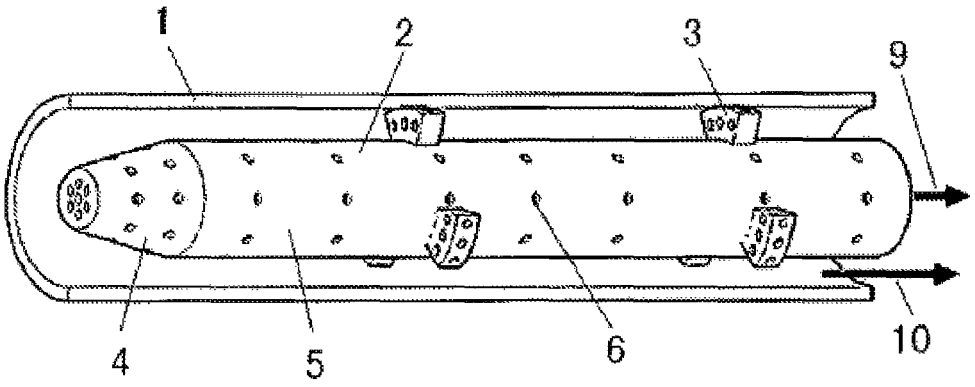
FIG. 1 is a structure diagram of an internal liquid separating hood-type condensation heat exchange tube with a microporous wall surface separating hood.

FIG. 1 is a structure diagram of an internal liquid separating hood-type condensation heat exchange tube with a microporous wall surface separating hood, the internal liquid separating hood-type condensation heat exchange tube consisting of an external heat exchange tube 1, an internal liquid separating hood 2 and supports 3.

The internal liquid separating hood 2 is the key component of the condensation heat exchange tube and consists of a drag reduction hood 4 and a primary liquid separating hood 5, both two sections have the porous structure 6.

The porous structure 6 is micropores on the wall surface. The micropores may be directly punched on the wall surface of the internal liquid separating hood 2, or, the porous structure is machined from foam metals, porous ceramics and other porous materials. The micropores may be distributed on the tube body uniformly or non-uniformly, sparse in the annular flow region and dense in the slug flow and plug flow regions according to condensation flow patterns of different working mediums.

Figure 2:
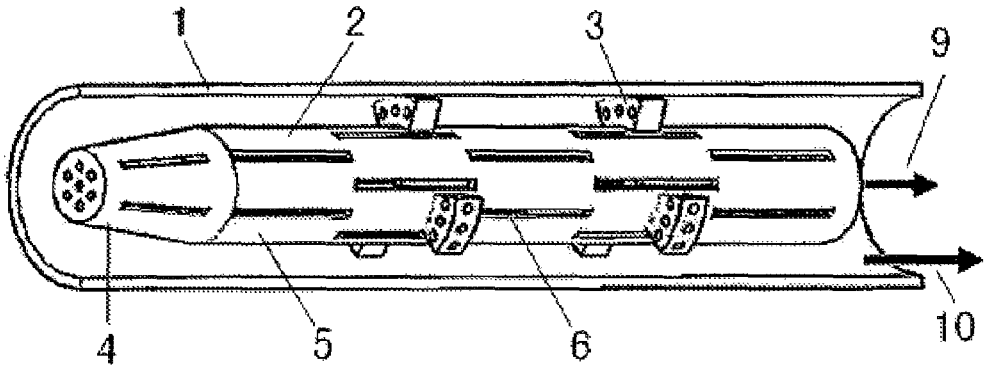
FIG. 2 is a structure diagram of an internal liquid separating type condensation heat exchange tube with a slit wall surface separating hood.

FIG. 2 is a structure diagram of an internal liquid separating hood-type condensation heat exchange tube with a slit wall surface separating hood, the internal liquid separating hood-type condensation heat exchange tube consisting of an external heat exchange tube 1, an internal liquid separating hood 2 and supports 3. The internal liquid separating hood 2 includes two parts: a drag reduction hood 4 and a primary liquid separating hood 5, both two sections have the porous structure 6. However, the porous structure 6 is in a slit form. The slits may be distributed in parallel, in a staggered form or crosswise.

Figure 3:
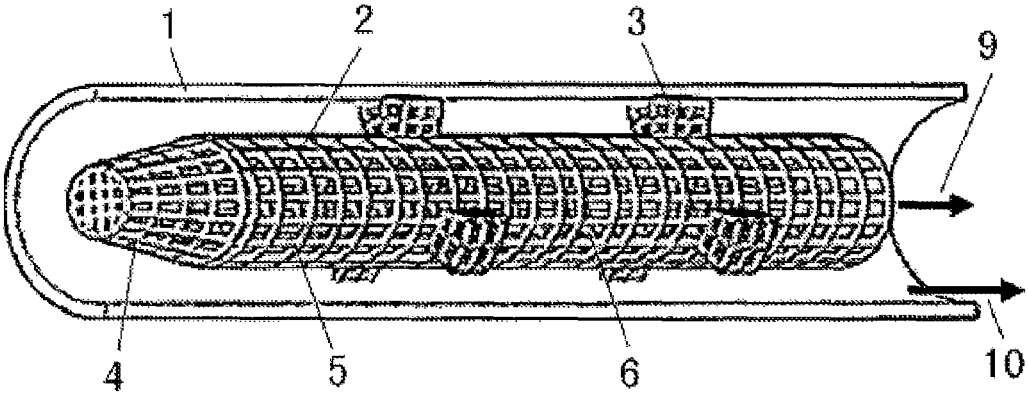
FIG. 3 is a structure diagram of an internal liquid separating hood-type condensation heat exchange tube with a wire mesh structure separating hood.

FIG. 3 is an internal liquid separating hood-type condensation heat exchange tube with a wire mesh structure separating hood, the internal liquid separating hood-type condensation heat exchange tube consisting of an external heat exchange tube 1, an internal liquid separating hood 2 and supports 3. The internal liquid separating hood 2 includes two parts: a drag reduction hood 4 and a primary liquid separating hood 5, both two sections have the porous structure 6. The internal liquid separating hood 2 is woven from metal wire meshes with different numbers.

Figure 4:
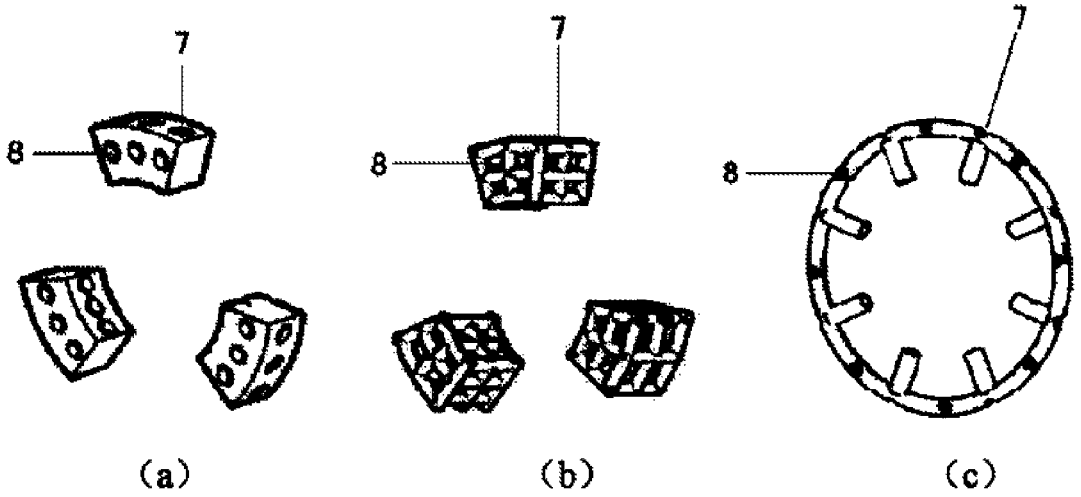
FIG. 4 is a structure diagram of supports of an internal liquid separating hood-type condensation heat exchange tube, where: (a) is a support of a porous structure, (b) is a support of a wire mesh structure, and (c) is a support with conduit structure.

FIG. 4 is a diagram of supporting structure of an internal liquid separating hood-type condensation heat exchange tube, Three types of supporting structure are available: (a) a porous supporting structure, (b) a wire mesh supporting structure, and (c) a conduit supporting structure.

Such supporting structures all consist of a plurality of supports. One support is installed in the gap between the internal liquid separating hood 2 and the external heat exchange tube 1 every a certain distance in the direction of the tube length.

For a porous supporting structure, each support has three legs which are of a porous structure. The three legs are distributed on a same cross section. The porous structure may be machined by punching the material in axial plane and vertical plane.

For a wire mesh supporting structure, each support has three legs which are of a wire mesh porous structure. The three legs are distributed on a same cross section. The wire mesh porous structure is formed by welding multiple layers of metal wire meshes vertically and crosswise.

The porous in the porous supporting structure and the wire mesh supporting structure form two channels: vertical channels 7 and parallel channels 8, which are perpendicular and parallel to the condensation heat exchange tube, respectively.

For a conduit supporting structure, each support has an annular conduit as the main body. The annular conduit is sleeved on the internal liquid separating hood 2 and in contact with the external heat exchange tube 1, but not in contact with the internal liquid separating hood 2. The annular conduit is connected with the internal liquid separating hood 2 via a series of short conduits. Micropores are machined at the conjunction of the annular conduit and the short conduits, thereby forming the vertical channels 7. Micropores are also machined between adjacent vertical channels 7 on the annular conduits, thereby forming the parallel channels 8.

The vertical channels 7 of the three supports are mainly used for separating the condensate in the near-wall region of the external heat exchange tube 1 in time so as to improve the update rate of the condensate in the near-wall region. The parallel channels 8 are mainly used for discharging the major liquid in the thick liquid film region and the liquid bridge region by aiding the primary liquid separating hood 5 in the parallel direction.

The aperture size of the porous structures 6 of both the internal liquid separating hood 2 and the supports 3 is related to the surface tension of the condensate. The equivalent diameter of the micropores (or slits) depends on the surface tension of the condensate $$\left(d \le 1.83\sqrt{\frac{\sigma}{g(\rho_f - \rho_g)}}\right),$$

so that only liquid is allowed to enter the micropores (or slits) under the drive of a curve pressure difference.

The invention can be used in any occasions requiring vapor condensation. The internal liquid separating hood-type condensation heat exchange tubes may be used alone, or used in a combination of multiple tubes, or assembled into a new condenser for use. In the invention, the capillary structure is employed to realize the separation of vapor-liquid and formed different flow channels for vapor and liquid in the condensation heat exchange tube, free of influence of gravity. The condensation heat transfer performance may be obviously improved and the enhancement effect is not influenced by gravity, so the condensation tube can be applied in various gravity force environments.

Embodiment 1

For the water steam condensation process, an ordinary smooth copper tube 50 cm in length and ϕ12 mm*1 mm in diameter is selected as an external heat exchange tube 1. A metal wire mesh with 14 meshes, 0.4 mm in wire diameter and 1.4 mm in aperture is cut into a rectangular wire mesh 35 mm in length and 18.84 mm in width (the width is equal to the circumference of a primary liquid separating hood 5), and then coiled to form the cylindrical primary liquid separating hood 5 of the internal liquid separating hood 2, which is ϕ6 mm in diameter and 35 cm in length. The same wire mesh is cut into a trapezoidal wire mesh that is then coiled to form a profile of the drag reduction hood 4 in a shape of truncated cone and a circular wire mesh that is used as a top cover of the drag reduction hood 4. Multiple sectored wire meshes are cut to form supports of a wire mesh structure 2 mm in height. The drag reduction hood 4, the primary liquid separating hood 5 and the wire mesh supports 3 are welded integrally, and then placed in the smooth external heat exchange tube 1, to obtain an internal liquid separating hood-type condensation heat exchange tube with a wire mesh structure separating hood.

The internal liquid separating hood 2, consisting of the drag reduction hood 4 and the primary liquid separating hood 5, is coaxial to the external heat exchange tube 1, has the same length as the external heat exchange tube 1, and runs through the external heat exchange tube 1. The start and tail ends of the internal liquid separating hood 2 are aligned with the ends of the external heat exchange tube 1. The drag reduction hood 4 has a length of 15 cm (i.e. equal to the sum of lengths of all flow patterns prior to the annular flow pattern during the condensation process). The start end (end with a small cross-section) of the drag reduction hood 4 is located on one side of the gas inlet of the condensation heat exchange tube, while the tail end of the drag reduction hood 4 is connected with the start end of the primary liquid separating hood 5. The gap between internal and external tubes of the condensation heat exchange tube is 2 mm.

When the aperture size of the porous structures 6 in both the internal liquid separating hood 2 and the supports 3 is 1.4 mm, while, $$1.83\sqrt{\frac{\sigma}{g(\rho_f - \rho_g)}} \approx 4.8 \text{ mm}$$

with, $\sigma$=0.06794 N/m, g=9.8 m/s$^2$, $\rho_f$=987.99 kg/m$^3$, $\rho_g$=0.0831 kg/m$^3$ for the water condensation in 1 atm, at 50° C., Due to 1.4 mm<4.8 mm, the aperture d meets the following formula:

$$d \le 1.83\sqrt{\frac{\sigma}{g(\rho_f - \rho_g)}}.$$

Therefore, the liquid water in the condensation phase-change process can be successfully sucked towards the internal liquid separating hood 2 via the porous structure and then discharged from the condensation heat exchange tube in time, so that liquid flows in the internal liquid separating hood while vapor flows in the annular space between the external heat exchange tube 1 and the internal liquid separating hood 2, thereby improving the efficiency of the phase-change heat transfer.

The above contents just describe preferred specific embodiments of the invention. However, the invention will not be limited thereto. For an ordinary person skilled in the art, the invention may have various changes or replacements within the technical scope disclosed by the invention, and these changes or replacements should fall into the protection scope of the invention. Therefore, the protection scope of the invention should be subject to that defined by the claims.

What is claimed is:

1. An internal liquid separating hood-type condensation heat exchange tube, comprising an external heat exchange tube (1), wherein the cavity of the external heat exchange tube (1) is provided with an internal liquid separating hood (2) coaxial to the external heat exchange tube and the internal liquid separating hood (2) is a hollow tube with a wall surface of a porous structure (6), the porous structure (6) referring to a structure where a plurality of micropores or gaps with an equivalent diameter of d, $$d \leq 1.83\sqrt{\frac{\sigma}{g(\rho_f - \rho_g)}},$$

are distributed on the wall surface, where: σ represents the surface tension of the condensate, g represents the acceleration of gravity, $\rho_f$ represents the density of the condensate, and $\rho_g$ represents the density of vapor phase.

2. The condensation heat exchange tube according to claim 1, wherein the external heat exchange tube (1) is a smooth heat exchange tube, or a heat exchange tube with an expanded heating area.

3. The condensation heat exchange tube according to claim 2, wherein the heat exchange tube with an expanded heating area is a fin tube, groove tube or corrugated tube.

4. The condensation heat exchange tube according to claim 1, wherein the internal liquid separating hood (2) includes two parts: a drag reduction hood (4) and a primary liquid separating hood (5), both of which are of a porous structure (6), the drag reduction hood (4) being located on one side close to a gas inlet of the condensation heat exchange tube, the drag reduction hood (4) being a hollow truncated cone, cone or other streamline shapes gradually expanding towards the flow direction of fluid; and the tail end of the drag reduction hood (4) is connected with the start end of the primary liquid separating hood (5) that is in a shape of circular tube.

5. The condensation heat exchange tube according to claim 4, wherein the condensate is discharged from the tail end of the primary liquid separating hood (5), which end is aligned with the tail end of the external heat exchange tube (1).

6. The condensation heat exchange tube according to claim 1, wherein the internal liquid separating hood (2) is machined from metal bare tubes, foam metal tubes, metal wire meshes or porous ceramics.

7. The condensation heat exchange tube according to claim 1, wherein the micropores or gaps are circular pores, square pores or slits, in a single size or multiple sizes.

8. The condensation heat exchange tube according to claim 1, wherein the micropores or gaps are distributed uniformly, non-uniformly, in parallel, in a staggered form or crosswise.

9. The condensation heat exchange tube according to claim 1, wherein supports (3) are provided between the external heat exchange tube (1) and the internal liquid separating hood (2) for supporting the internal liquid separating hood (2) so as to distribute the internal liquid separating hood (2) in the cavity of the external heat exchange tube (1) symmetrically and uniformly.

10. The condensation heat exchange tube according to claim 9, wherein the supports (3) are of a porous structure (6) forming two kinds of channels vertical to the condensation heat exchange tube and parallel to the condensation heat exchange tube, respectively: vertical channels (7) and parallel channels (8) for pumping the condensate to the internal liquid separating hood (2).

* * * * *